US007073204B1

(12) United States Patent
Boyles

(10) Patent No.: US 7,073,204 B1
(45) Date of Patent: Jul. 11, 2006

(54) GARMENT WITH A COMPARTMENT

(76) Inventor: Kathleen Anne McHugh Boyles, 74 Green Hills La., New Market, VA (US) 22844

( * ) Notice: Subject to any disclaimer, the term of this patent is extended or adjusted under 35 U.S.C. 154(b) by 0 days.

(21) Appl. No.: 10/618,995

(22) Filed: Jul. 14, 2003

(51) Int. Cl.
*A41D 10/00* (2006.01)

(52) U.S. Cl. ..... 2/114

(58) Field of Classification Search ..... 2/114, 2/115, 69, 69.5, 8, 102, 94, 48, 49.1, 51, 75, 2/111, 83, 104, 247, 249, 250
See application file for complete search history.

(56) References Cited

U.S. PATENT DOCUMENTS

| | | | | |
|---|---|---|---|---|
| 1,998,051 | A | 4/1935 | Gerber | |
| 4,144,593 | A * | 3/1979 | Timmons | 2/104 |
| 4,171,542 | A | 10/1979 | Cox | |
| 4,570,268 | A | 2/1986 | Freeman | |
| 4,688,270 | A | 8/1987 | Denicola | |
| 4,698,848 | A | 10/1987 | Buckley | |
| 4,718,124 | A | 1/1988 | Sawicki | |
| 4,759,083 | A | 7/1988 | Belcher | |
| 4,791,681 | A | 12/1988 | Dean | |
| 5,048,122 | A | 9/1991 | Prieur | |
| 5,097,536 | A | 3/1992 | Cohen | |
| 5,133,086 | A | 7/1992 | Truitt | |
| 5,184,351 | A | 2/1993 | Benstock | |
| 5,507,460 | A | 4/1996 | Schneider | |
| 5,564,123 | A | 10/1996 | Grassick | |
| 5,611,086 | A * | 3/1997 | Eggen | 2/104 |
| 5,806,096 | A * | 9/1998 | Pennington | 2/80 |
| 5,991,923 | A | 11/1999 | Maria | |
| 6,032,289 | A * | 3/2000 | Villapiano | 2/102 |
| 6,048,252 | A * | 4/2000 | Sebring | 450/1 |
| 6,272,685 | B1 | 8/2001 | Kumar | |
| 6,450,168 | B1 | 9/2002 | Nguyen | |
| 6,477,710 | B1 | 11/2002 | Ojoyeyi | |
| 6,574,800 | B1 * | 6/2003 | Leger et al. | 2/114 |
| 6,647,552 | B1 * | 11/2003 | Hogan | 2/114 |
| 6,681,404 | B1 * | 1/2004 | Adlard et al. | 2/94 |
| 2003/0229930 | A1 * | 12/2003 | Carlson | 2/114 |
| 2004/0143885 | A1 * | 7/2004 | Rothman | 2/104 |
| 2004/0226073 | A1 * | 11/2004 | McCullar et al. | 2/114 |

* cited by examiner

*Primary Examiner*—Alissa L. Hoey
(74) *Attorney, Agent, or Firm*—Michael Haynes PLC; Michael N. Haynes

(57) ABSTRACT

Certain exemplary embodiments comprise a garment comprising a compartment that can comprise a volume substantially sufficient to contain a medical apparatus. A compartment can be comprised of an inner and an outer layer of material, with the outer layer comprised of two or more releasably attaching outer panels. The inner layer of a compartment can comprise a releasably attachable vertical joint that can allow access to a wearer's body for insertion and manipulation of a medical apparatus.

31 Claims, 5 Drawing Sheets

GARMENT WITH A COMPARTMENT

BRIEF DESCRIPTION OF THE DRAWINGS

A wide array of potential embodiments can be better understood through the following detailed description and the accompanying drawings in which.

DETAILED DESCRIPTION

Figure 1:
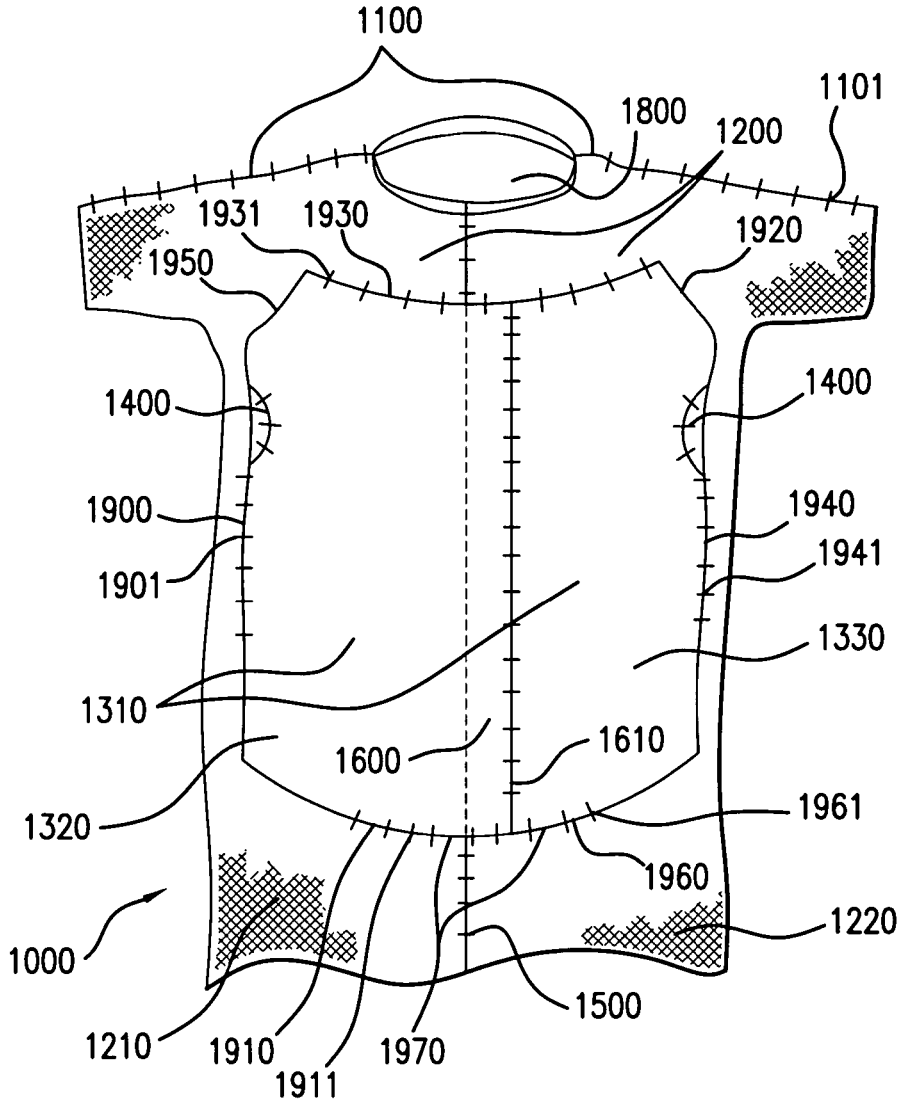
FIG. 1 is a front view of an exemplary embodiment of a compartment for a garment.

Certain exemplary embodiments provide a device comprising a garment comprising a compartment. As used herein, the term "garment" refers to any article of clothing that covers a substantial portion of a torso of a wearer of the garment, such as a shirt, blouse, dress, vest, sweater, sweatshirt, jumpsuit, t-shirt, tank top, slip, camisole, teddie, gown, pajama, romper, and/or onesy, etc. A compartment can be defined by an inner and outer layer, either of which can be formed from at least one panel. As used herein, the term "panel" refers to a piece of material used in fabricating a garment. A panel can be permanently and/or releasably attached to other panel pieces comprising a garment, such as at a joint. As used herein, the term "permanently attached" means attached in a fashion that requires some level of destruction to detach (e.g. destruction of threads, a glue bond, etc.), while "releasably attached" means attached in a fashion that can be non-destructively detached (e.g. opening a zipper, releasing a hook portion from a loop portion of a hook-and-loop fastener system, unbuttoning, etc). As used herein, the term "joint" refers to an attachable, partially attachable, and/or unattachable junction of two or more panels comprising a garment, any such attachment used for attaching the panels being releasable and/or permanent. Moreover, a joint can comprise a combination of substantially intersecting joints. As used herein, the term "attachment" and/or "means for attaching" refers to something that at least partially attaches one thing to another, such as one or more attachment systems or component thereof coupled and/or couplable to a component of a garment, such as for example, a hook and/or loop of a hook and loop fastener system, fasteners, buttons, hooks, catches, snaps, latches, buckles, loops, ties, clamps, connectors, couplers, links, bands, zippers, releasable adhesive, and/or any other releasable means for attachment, and/or a seam, stitch, glue, bond, weld, and/or any other permanent means for attachment. Any attachment and/or means for attaching can be made of a non radio-opaque substance. As used herein, the term "releasable" means generally intended and/or configured to release, be manually released, to reattach, and/or be manually reattachable. As used herein, the term "layer" refers to, for example, an exterior or interior material of a garment. As used herein, the term "compartment" refers to a chamber formed in a garment between an outer layer and an inner layer of the garment. As used herein, the term "inner" refers to an orientation generally closer to a body of a wearer than an orientation that is designated "outer". As used herein, the term "edge" refers to a line of intersection of two surfaces, such as a potentially linear and/or curvilinear intersection between an inner surface and an outer surface of a panel. For example, an attachment can be located on an edge of a panel and can be attached and/or attachable to form a joint.

Certain exemplary embodiments provide a device comprising a garment comprising a compartment. The compartment can be defined by an inner and outer layer, with the inner layer comprising a means to access a garment wearer's body through a substantially vertical joint. The outer layer can be comprised of two or more outer panels that can releasably attach and/or detach at a substantially vertical joint. The compartment can be accessed externally through one or more openings, such as lateral openings. The compartment can define a volume substantially sufficient to hold a medical apparatus and can contain a means to brace the medical apparatus within. The compartment can comprise a means to access a region of a wearer of the garment without requiring the removal of the garment from the wearer.

Certain exemplary embodiments of the compartment can allow access to the wearer's body, provide a protective barrier between the wearer and the medical apparatus, allow convenient access to the medical apparatus and/or the wearer's body, reduce and/or eliminate external visibility of the medical apparatus, and/or minimize operational interference with the medical apparatus.

FIG. 1 is a front view of an exemplary embodiment of a garment 1000. Garment 1000 can comprise an outer layer 1310, and an inner layer 1200. Inner layer 1200 can be comprised of panels 1210 and 1220 along with at least one panel 1800. Alternatively, an inner layer can be comprised of a single or plurality of panels. Panels comprising inner layer 1200 and/or outer layer 1310 can be attached permanently and/or releasably (e.g., detachably and reattachably) at various points on garment 1000.

In certain exemplary embodiments, garment 1000 can be designed for any age, gender, purpose, and/or clothing size, etc. Certain exemplary embodiments of garment 1000 can have various styles, such as any degree of neck coverage ranging from full coverage, such as that found in turtlenecks, to partial neck coverage such as that found in various styles of collared shirts, to substantially no neck coverage, such as that found in t-shirts or V-necked shirts; any degree of torso coverage, ranging from full coverage, such as that found in a sweater, to limited coverage, such as that found in a midriff-bearing top; any degree of arm coverage, ranging from full coverage, such as that found in long sleeved shirts or blouses, to substantially no arm coverage such as that found in tank tops; and/or any degree of leg coverage, ranging from full coverage, such as that found in overalls or jumpsuits, to partial leg coverage, such as that found in various gowns, to substantially no leg coverage, such as that found in onsies and the like; etc.

Garment 1000 can be fabricated from any material, which can be of composed of any substance, including but not limited to cotton, rayon, lycra, acrylic, polyester, paper, wool, linen, silk, and/or various combinations thereof. Garment 1000 can be comprised of at least one material that is non radio-opaque. As used herein, the term "non radio-opaque" means appearing substantially radiographically transparent or translucent. Certain exemplary embodiments of garment 1000 can be packaged as sterile.

The body of a wearer of garment 1000 can be accessed via a joint, such as a substantially vertical joint 1500 defined by an intersection of a first inner panel 1210 and a second inner panel 1220 that can be releasably attachable to each other and/or can combine to comprise inner layer 1200. The outer layer 1310 can be formed by a first outer panel 1320 that can be releasably attachable to a second outer panel 1330, and can be partially permanently attached to inner layer 1200 and/or garment 1000. An exemplary embodiment can have a segment 1600 of first outer panel 1320 that overlaps and/or overlies a portion of second outer panel 1330, with the overlapping segment 1600 located along, for example, a vertical centerline of garment 1000, which can be approximately aligned with a vertical centerline of a wearer of the garment. First outer panel 1320 and second outer panel 1330 can be releasably attached along, for example, a centerline of a garment 1000 by any attachment and/or means for attaching 1610, which, like any attachment disclosed herein, can be made of a non radio-opaque substance.

In certain exemplary embodiments, an inner layer edge 1100 can be releasably attachable on a shoulder joint 1101 extending between a neck area and a sleeve end. Such releasable attachability on shoulder joint 1101 can allow the garment 1000 to be placed on the wearer's body with greater ease.

In certain exemplary embodiments, first outer panel 1320 can be at least partially permanently attached to garment 1000. First outer panel 1320 can be releasably attachable along at least a portion of edge 1900 via a first lateral attachment 1901. Second outer panel 1330 can be at least partially permanently attached to garment 1000. Second outer panel 1330 can be releasably attachable along at least a portion of edge 1940 via a second lateral attachment 1941. First outer panel 1320 can be at least partially releasably attachable to garment 1000 via a first base attachment 1911 located along first base edge 1910. Second outer panel 1330 can be at least partially releasably attachable to garment 1000 via a second base attachment 1961 located along second base edge 1960. Such attachment of outer panels 1320, 1330 can form a secure base 1970 for the outer layer. The secure base 1970 can provide support for medical devices attachable to the wearer. Outer panels 1320, 1330 can also and/or alternatively be at least partially permanently attached to inner panels 1210, 1220 along any and/or all edges 1900, 1940, 1910, 1960, 1950, and/or 1920. Because any of joints 1901, 1941, 1911, 1961, 1950, and/or 1920 can be releasably attached, outer panels 1320, 1330 can be releasably attachable to inner layer 1200 and/or inner panels 1210, 1220, and/or releasably and/or repeatedly closable and openable along edges 1900, 1940, 1910, 1960, 1950, and/or 1920. In certain exemplary embodiments, edges 1950, 1930, and 1920 can be colinear defining an approximate straight line.

Either of outer panels 1320, 1330 can be present with no attachment and/or unattachable to inner layer 1200 along edge 1930. Alternatively, outer panels 1320, 1330 can be releasably attachable to inner layer 1200 and/or garment 1000 along edge 1930 to form a joint 1931.

All or any portion of either outer panel 1320, 1330 can be fixedly attached to corresponding inner panel 1210, 1220 and/or to garment 1000. All or any portion of either outer panel 1320, 1330 can also be seamlessly incorporated into garment 1000, with either inner panel 1210, 1220 being separately attached to garment 1000. As used herein, "seamlessly" means that a structure, such as an outer panel 1320, is an extension of an adjacent structure, such as layer 1200, and/or the main body of garment 1000. Alternatively, all edges of either outer panel 1320, 1330 can be releasably attachable to allow rapid and/or complete removal of either that outer panel 1320, 1330 or outer layer 1310.

An exemplary embodiment of an outer panel 1320 can have one or more releasably closable openings 1400. One or more releasably closeable openings 1400 can be laterally oriented with respect to, and/or on a lateral edge of, outer layer 1310. Any opening 1400 can allow for external access to an interstitial area between inner layer 1200 and outer layer 1310 without disturbing the integrity of inner layer 1200 which can be in contact with a body of a wearer of garment 1000.

Figure 2:
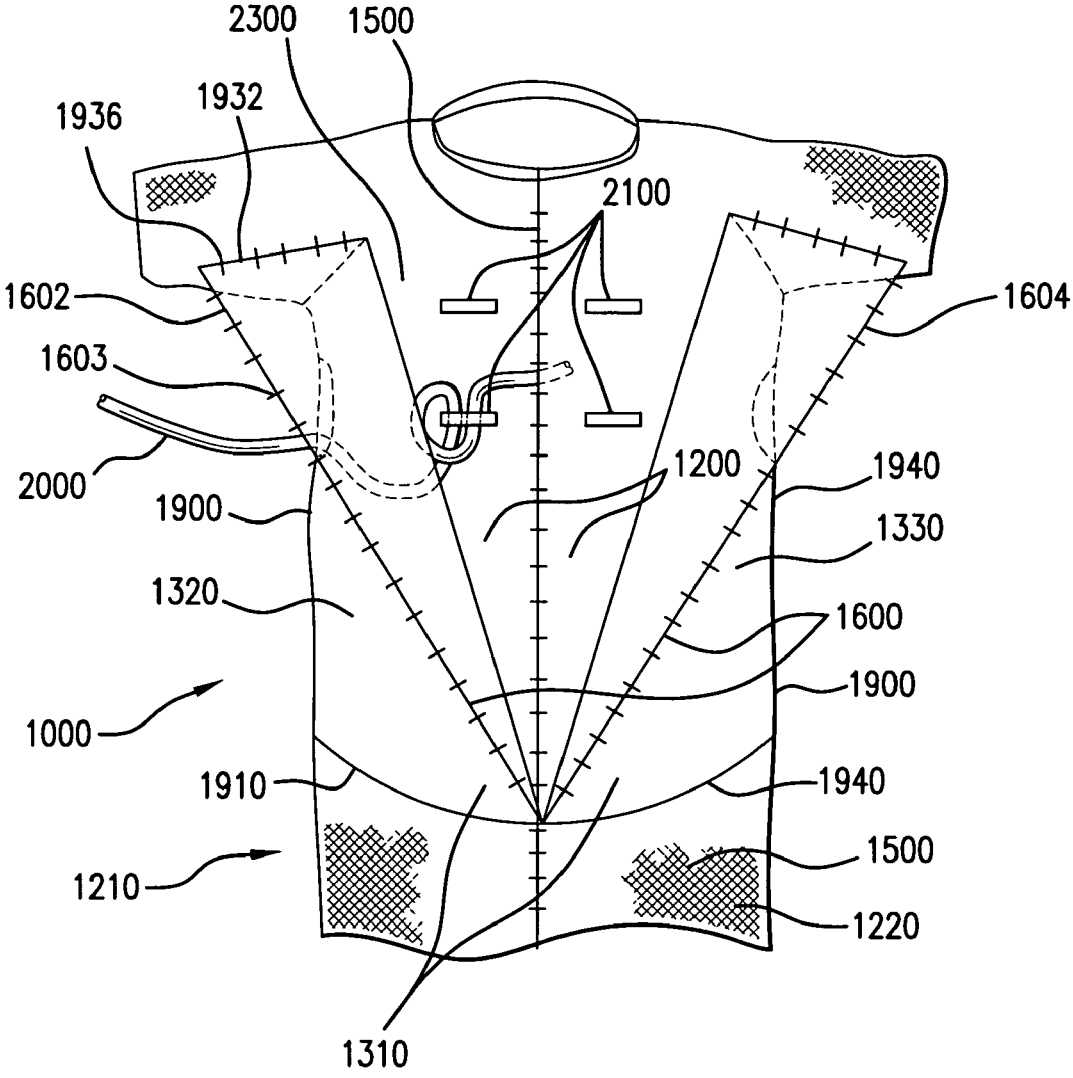
FIG. 2 is a front view of an exemplary embodiment of a compartment for a garment with an open outer layer.

FIG. 2 is a front view of an exemplary embodiment of a garment 1000 comprising a compartment 2300 and showing outer panels 1320 and 1330 in open positions. Opening outer panels 1320 and 1330 can allow access to compartment 2300 and/or to inner layer 1200 of garment 1000. Compartment 2300 can be sized and/or fitted to conform to a general shape of any particular garment 1000. Compartment 2300 can be located anteriorly, posteriorly, and/or laterally in relation to a wearer's body.

In an operative embodiment in which outer panels 1320 and 1330, and releasable attachment 1600 are in a closed position, as shown in FIG. 1, garment 1000 can define a first opening in communication with compartment 2300, that first opening defining a first perimeter of a finite and non-zero length, that first perimeter defined, for example, by edge 1931 and inner layer 1200, edge 1931 being at least partially unattached to inner layer 1200.

In an operational embodiment in which outer panels 1320 and 1330, and releasable attachment 1600 are in a closed position, as shown in FIG. 1, and in which attachments 1910, 1940, and 1930 are attached and/or closed, the perimeter of the first opening can be approximately zero.

In an operational embodiment in which outer panels 1320 and 1330, edges 1600 are in an open position, as shown in FIG. 2, garment 1000, and potentially edges 1602, 1604, 1932, 1934, and inner layer 1200 can define a second opening in communication with compartment 2300, that second opening having a second perimeter, a ratio of the second perimeter of the second opening to the first perimeter of the first opening from approximately 1.2 to approximately 10, including all values therebetween, such as approximately 1.5, 1.999, 3.01, 4, 6.1, and/or 8.89, etc., and including all sub-ranges therebetween, such as approximately 2.52 to approximately 5, etc.

In certain exemplary embodiments in which at least a portion of one or more of, for example edges 1901, 1910, 1932, and/or 1602 are releasably attachable, compartment 2300 can be opened along at least a portion of a plurality of joints, such as for example, two, three, four, or more joints. Moreover, as shown for joints 1936 and 1603, located along edges 1932 and 1602 respectively, at least two openable joints and/or edges can intersect in a non-parallel manner, that is, at an angle of from approximately 20 degrees to approximately 160 degrees, including all values therebetween, such as approximately 44.9, 60.002, 90, 119, and/or 149.7, etc. degrees, and including all sub-ranges therebetween, such as approximately 85.1 to approximately 95 degrees, etc. Thus, two or more joints can intersect substantially perpendicularly. Alternatively, any joint and/or intersecting combination of joints can comprise: a substantially linear portion, a substantially curvilinear portion, a substantially vertical portion and a substantially non-vertical portion, two or more parallel portions, two or more non-parallel portions, two or more perpendicular portions, and/or two or more non-perpendicular portions.

A fully or partially releasably unattached joint, such as an opened joint 1603 located along edge 1602 of outer layer 1310, can cause a portion of a volume of compartment 2300 to become unbounded and/or essentially infinite until the joint becomes releasably attached and/or closed.

Compartment 2300 can provide a chamber for use in caring for the wearer of garment 1000. As used herein, the term "coupling" refers to any means of attaching, inserting, connecting, etc., a medical apparatus 2000 to the wearer. Exemplary embodiments of compartment 2300 can contain a medical apparatus 2000, which can be any medical device, couplable to the body of a wearer of garment 1000 for any purpose, such as for example gastrostomy, colostomy, ileostomy, and/or any gavage therapy, etc. In certain embodiments, medical apparatus 2000 can comprise tubing that can reside within compartment 2300 for purposes relating to any type of intravenous therapy, fluid delivery, and/or fluid extraction. Medical apparatus 2000 can comprise devices couplable to medical tubing, such as colostomy or catheter bags, which can also be contained within compartment 2300. Medical apparatus 2000 can provide a monitoring function, such as a cardiac function monitor, sphygmomanometer, and/or pacemaker, etc. Medical apparatus 2000 can have a first portion and second portion. The first portion of medical apparatus 2000 can be couplable to the body of the wearer of garment 1000. The second portion of medical apparatus 2000 can be attachable to medical devices.

Medical apparatus 2000 can be attached to, inserted into, and/or coupled to a portion of a body of a wearer of garment 1000. Medical apparatus 2000 can be insertable through and/or via a joint 1500 in inner layer 1200 of compartment 2300, and can at least partially reside within compartment 2300. Joint 1500 can define an opening of any shape and/or location, including a slit, an oval, a circle, a square, a triangle, and/or various combinations thereof. Joint 1500 can be substantially vertical, substantially horizontal, linear, curvilinear, and/or a combination thereof. Joint 1500 can be lined in plastic, rubber, and/or any reinforced material appropriate for a particular medical apparatus 2000. Within compartment 2300, outer layer 1310 and/or inner layer 1200 can include bracements 2100. As used herein, the term "bracement" refers to any means to locate, support, and/or secure medical apparatus 2000. Bracements 2100 can include loops, attachments, hook and loop fasteners, ties, clips, pockets, straps, belts, tape, adhesive, and/or any other means of fixing the location of, supporting, and/or securing, medical apparatus 2000, depending on the requirements of the medical apparatus 2000, and/or the preferences and/or needs of the wearer. Bracements 2100 can be positioned anywhere within compartment 2300, and can be attached to garment 1000, either of inner panels 1210, 1220, and/or either of outer panels 1320, 1330. Certain exemplary embodiments of garment 1000 can have either one or a plurality of separate pockets contained within compartment 2300 to serve as bracement 2100.

In certain exemplary embodiments, garment 1000 can be designed to incorporate compartment 2300 into an article of clothing so that the visibility of compartment 2300 and/or medical apparatus 2000 contained therein to an observer of garment 1000 can be minimized. That is, any component of garment 1000 can be comprised of a substantially visually opaque material, which can provide a means for substantially reducing a visibility of compartment 2300 and/or its contents to an observer. Thus, an exemplary embodiment of garment 1000 can be a shirt, with outer panels 1320 and 1330 overlapping along a centerline region of the shirt. The region of overlap 1600 can use any means of releasable attachment to secure the two overlapping outer panels 1320 and 1330 to appear similar to a typical shirt or blouse. Overlapping outer panels 1320 and 1330 can be continuous with the material of the shirt so that the overlapping outer panels 1320 and 1330 can appear to be seamlessly attached as part of a normal shirt. An additional panel can be attached within the shirt to form inner panel 1200 and thereby compartment 2300. Lateral attachments 1900 and 1940, and/or bottom attachments 1910 and 1960 between outer layer 1310 and inner layer 1200 can be internal to outer layer 1310, to minimize external visible cues to the existence of compartment 2300.

Any component of garment 1000 can be comprised of a substantially insular, insulating, and/or warming material, which can provide a thickness, construction, coefficient of thermal conductivity, resistance to convection, heat source, and/or any other means for maintaining a body temperature of a wearer when an ambient temperature is below approximately a temperature from approximately 70 degrees F. to approximately 20 degrees F., including all values therebetween, such as approximately 65.3, 59.999, 55, 50.02, 44, 39.8, 35, and/or 26.1, etc., degrees F., and including all sub-ranges therebetween, such as approximately 57 degrees F. to approximately 28 degrees F., etc.

Any component of garment 1000, such as for example the inner layer, can be comprised of a means for substantially reducing discomfort to the wearer from the medical apparatus. For example, any component of garment 1000 can be comprised of a substantially soft, comfortable, and/or wearable material, such as for example fabrics of cotton, wool, linen, silk, polyester, etc. having a thread count from approximately 40 threads per inch to about 600 threads per inch, including all values therebetween, such as approximately 180.2, 249.7, 300, 400, and/or 524, etc., threads per inch, and including all sub-ranges therebetween, such as approximately 200 threads per inch to approximately 412 threads per inch, etc.

An exemplary embodiment can be adapted to any form of garment, and can be appropriate for garments for adults, children, toddlers, and/or infants, such as shirts, blouses, sweaters, gowns, pajamas, rompers, and/or onsies, etc. The design and/or placement of compartment 2300 in garment 1000 can vary depending on the style and purpose of a particular article of clothing.

Certain exemplary embodiments of compartment 2300 can enhance aesthetics in a medical environment by concealing medical apparatus 2000. In certain embodiments, compartment 2300 can restrict patient access to medical apparatus 2000 and/or can help prevent an inadvertent dislodgment and/or damage of medical apparatus 2000. In certain embodiments, compartment 2300 can allow a medical professional, care provider, and/or the wearer to access medical apparatus 2000 without directly exposing or contacting a wearer's body since inner layer 1200 can remain fastened when outer layer 1310 is opened. In certain embodiments, inner layer 1200 can prevent irritation of skin of the wearer by medical apparatus 2000, such as tubing, by holding medical apparatus 2000 in compartment 2300.

Figure 5:
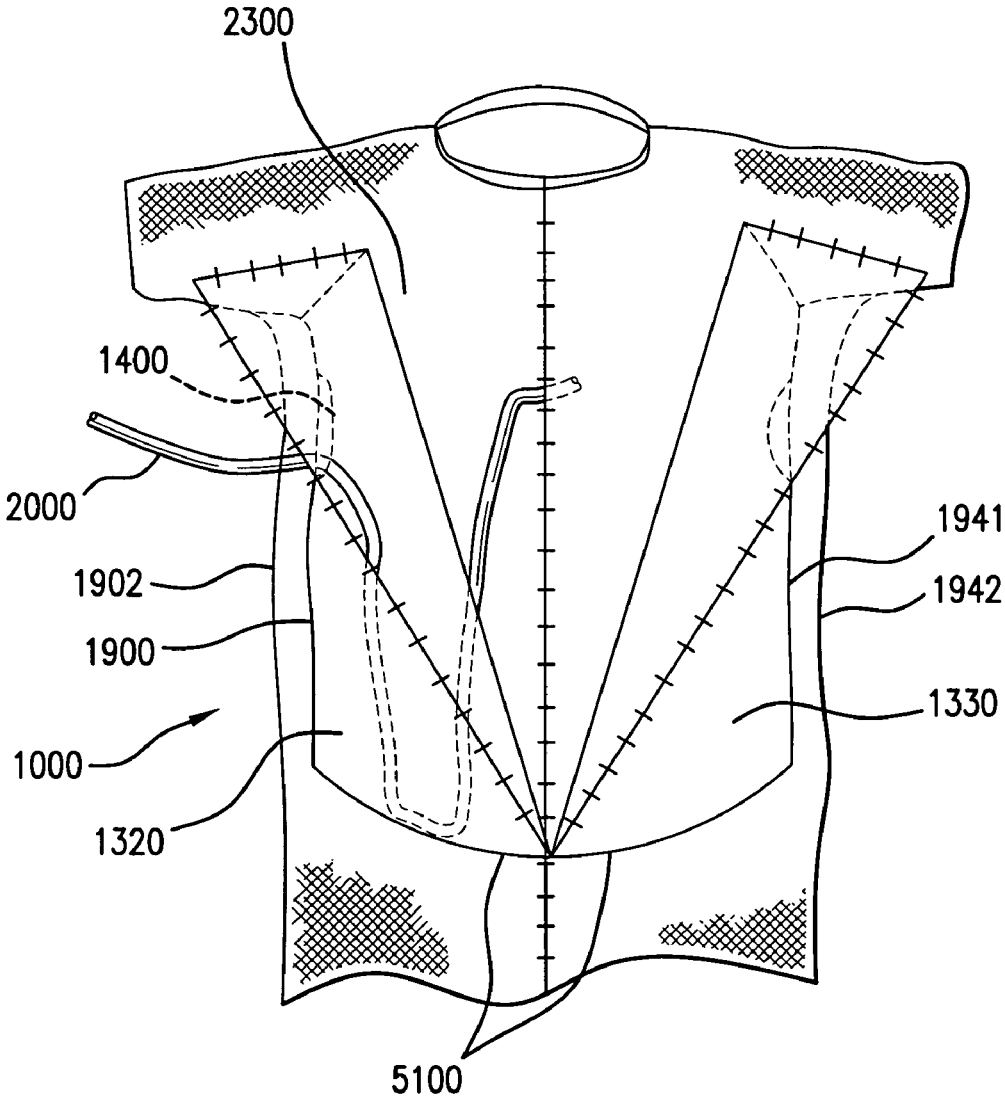
FIG. 5 is a front view of an exemplary embodiment of a compartment for a garment with an open outer layer.

FIG. 5 is a front view of an exemplary embodiment of a compartment for a garment with an open outer layer, the compartment without bracements. A first lateral edge 1900 of outer panel 1320 can be located medial to the first lateral-most boundary 1902 of garment 1000 which can correspond to a lateral-most portion of the wearer's body. Alternatively, first lateral edge 1900 can be located approximately colinear with the first lateral boundary 1902 of garment 1000. A second lateral edge 1941 of outer panel 1330 can be located medial to the second lateral-most boundary 1942 of garment 1000 which can correspond to a lateral-most portion of the wearer's body. Alternatively, second lateral edge 1941 can be located approximately colinear with the second lateral boundary 1942 of garment 1000.

Certain exemplary embodiments can have medical apparatus 2000 in compartment 2300 without bracements. A medical apparatus 2000 can be supported in compartment 2300 by fixed and/or releasable fasteners along edge 5100. The medical apparatus 2000 can have a first end attachable to the wearer. The medical apparatus 2000 can have a second end extending through releasably closable opening 1400.

Figure 3:
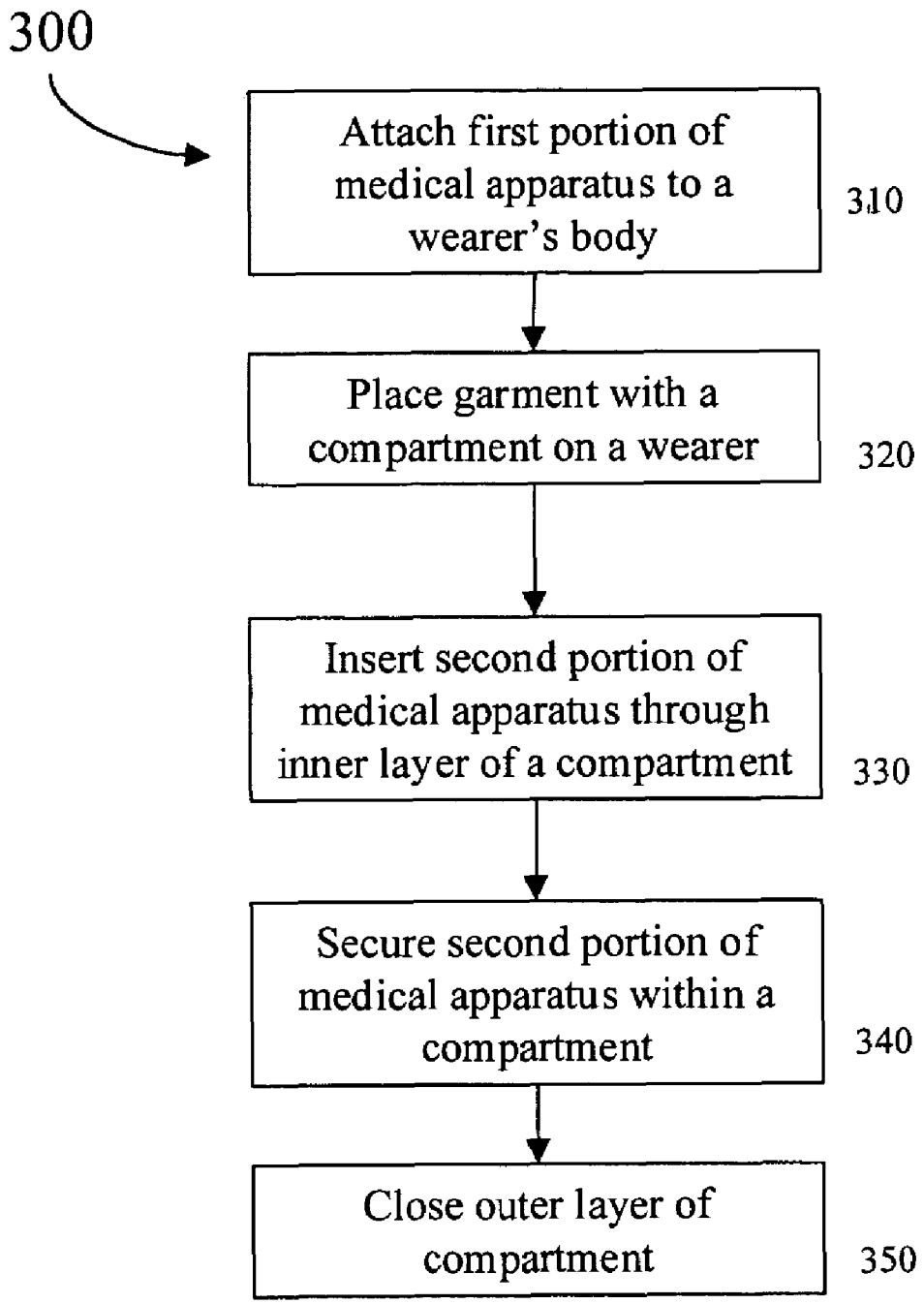
FIG. 3 is a flow chart of an exemplary embodiment of a method for utilizing an compartment for a garment.

FIG. 3 is a flow chart 300 of an exemplary embodiment of a method for using a compartment for a garment, such as garment 1000 of FIGS. 1 and 2. Note that, unless specified otherwise, no particular activity of flowchart 300 is required, and no particular sequence of activities is required. Thus, any activity shown on flowchart 300 can be omitted and/or the sequence of activities can vary.

At activity 310, a first portion of a medical apparatus can be attached and/or coupled to a wearer's body. At least a portion of the medical apparatus can be intrusive to the wearer's body, such as for example tubing inserted into and/or connected for any purpose, including gastrostomy, colostomy, ileostomy, and/or any gavage therapy, intravenous therapy, fluid delivery, fluid collection, etc., and/or at least a portion of an attached medical apparatus can be extrinsic to the wearer's body including for example an electrode, a cardiac function monitor, a sphygmomanometer, and/or a pacemaker, etc.

At activity 320, a garment can be placed on the wearer. The garment can cover a portion of the wearer's body. The wearer can extend his/her arms as required through the garment openings. The inner layer can be fastened and/or closed.

At activity 330, a second portion of the medical apparatus can be inserted through an opening in the inner layer of a compartment. The inner layer can isolate and/or separate the medical apparatus from the wearer's skin. Inner layer can be opened to allow changes to the medical apparatus without removing the garment.

At activity 340, the second portion of the medical apparatus can be braced within the compartment. Bracing the apparatus can reduce the likelihood that the wearer can dislodge the apparatus.

At activity 350, the outer panels of the compartment can be joined and/or closed. Joining and/or closing the outer panels can provide concealment and/or protection for the medical apparatus.

Figure 4:
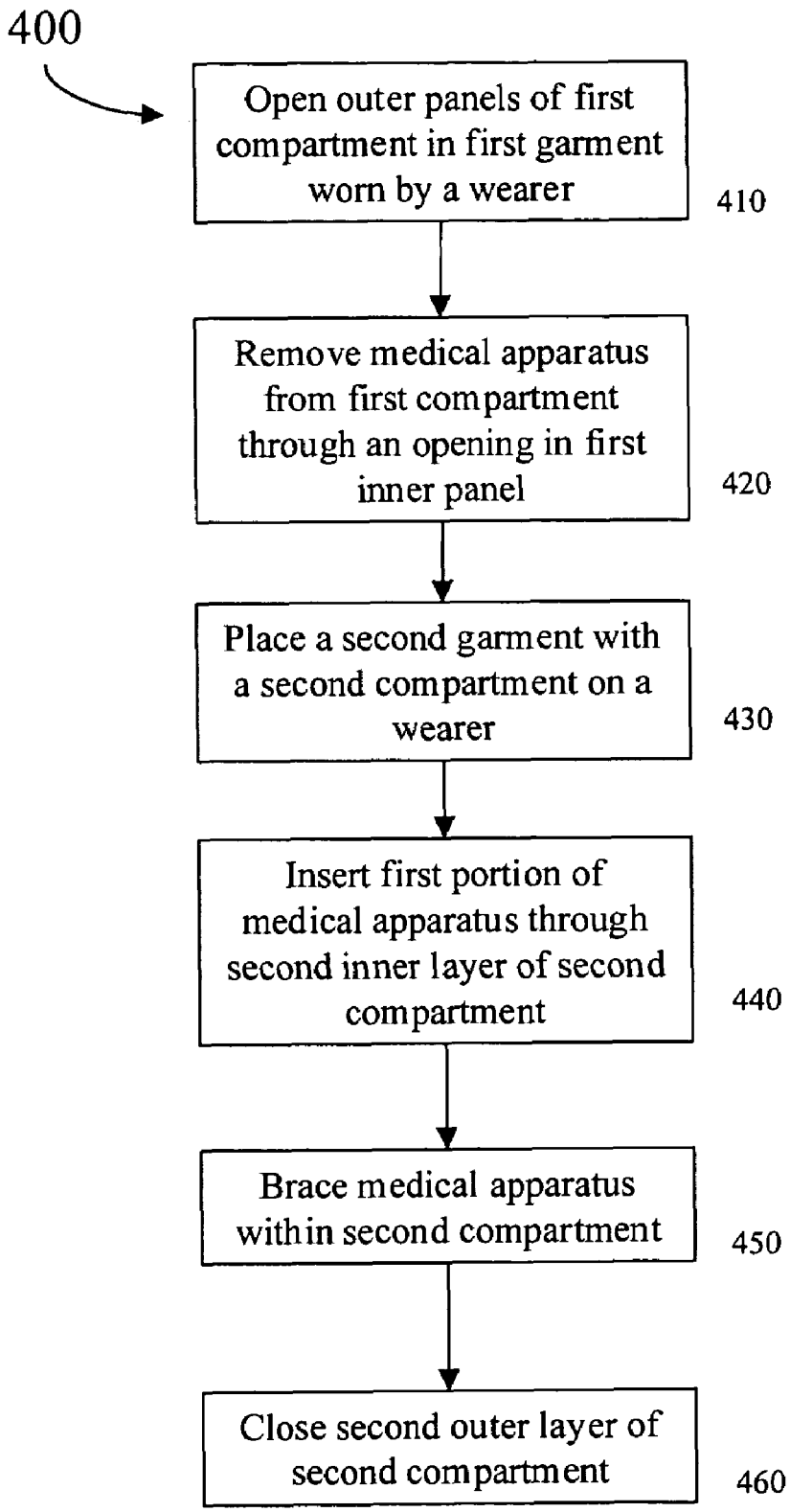
FIG. 4 is a flow chart of an exemplary embodiment of a method for using a compartment for a garment.

FIG. 4 is a flow chart 400 of an exemplary embodiment of a method for using a garment, such as garment 1000 of FIGS. 1 and 2. Note that, unless specified otherwise, no particular activity of flowchart 400 is required, and no particular sequence of activities is required. Thus, any activity shown on flowchart 400 can be omitted and/or the sequence of activities can vary.

At activity 410, the outer panels of a first garment worn by a wearer can be opened to reveal a medical apparatus residing within the compartment of the garment.

At activity 420, the medical apparatus can be removed from the compartment though an opening in an inner layer of the compartment. Thus, the apparatus can be removed from the compartment without disconnecting and/or decoupling the apparatus from the wearer's body.

At activity 430, the garment can be removed from the body of the wearer and/or a second garment, such as garment 1000 of FIGS. 1 and 2 can be placed on the wearer. The medical apparatus can remain attached to the wearer's body as the second garment is applied, installed, and/or placed on the wearer.

At activity 440, a first portion of the medical apparatus can be inserted through an opening in an inner layer of the second garment, and into a compartment of the second garment, potentially while the medical apparatus remains attached and/or coupled to the wearer.

At activity 450, the medical apparatus can be braced within the compartment of the second garment, by for example, releasably attaching the medical apparatus to the inner layer and/or the outer layer of the second garment. The medical apparatus can remain attached and/or in service as it is being braced in the compartment of the second garment.

At activity 460, a set of outer panels of the compartment of the second garment can be joined and/or closed. Joining and/or closing can take place with the medical apparatus continuing to be connected to the wearer.

Certain exemplary embodiments can be adapted for use with an animal such as a horse, cow, dog, cat, goat, and/or pig, etc.

Still other embodiments will become readily apparent to those skilled in this art from the above-recited detailed description of certain exemplary embodiments. It should be understood that numerous variations, modifications, and additional embodiments are possible, and accordingly, all such variations, modifications, and embodiments are to be regarded as being within the spirit and scope of the invention, which is defined by the claims. Accordingly, the drawings and descriptions are to be regarded as illustrative in nature, and not as restrictive.

What is claimed is:

1. A system comprising:

a medical tubing; and a garment, comprising:

an inner layer;

an outer layer combinable with said inner layer to define a compartment proximate to an operative region for said medical tubing;

said compartment at least partially bordered by a permanent attachment between said outer layer and said inner layer; said outer layer comprising a plurality of outer panels releasably attachable along a substantially vertical outer joint aligned approximately along a vertical centerline of a wearer of said garment;

said inner layer further comprising a releasably attachable substantially vertical inner joint for access to an anatomical region of a body of the wearer of said garment;

in a first operative mode, said inner joint releasably attached and said outer joint releasably attached, an opening to said compartment defining a first perimeter of a finite and non-zero length, in a second operative mode, said inner joint releasably closed and said outer joint at least partially open, said opening to said compartment defining a second perimeter, a ratio of said second perimeter to said first perimeter between approximately 1.2 and approximately 10;

in said second operative mode, said substantially vertical outer joint substantially intersecting a substantially non-vertical outer joint at an angle of from approximately 20 degrees to approximately 160 degrees;

said compartment comprising one or more access points along a lateral portion of said outer layer, said compartment defining a volume substantially sufficient to contain said medical tubing;

said compartment comprising a support for said medical tubing; and in a third operative mode:

said medical tubing residing within said compartment;

said compartment allowing insertion of said medical tubing into the anatomical region of the body of the wearer of said garment without removal of said garment;

said compartment comprising a support for said medical tubing proximate to the operative region for said medical tubing without substantially irritating a portion of skin of the wearer of said garment;

said compartment comprising a means for accessing said medical tubing without removal of said garment;

said compartment comprising a means for substantially limiting visibility of said medical tubing to an observer; and said compartment comprising a means for protecting said medical tubing from operational interference.

2. A device comprising:

a garment, comprising:

an inner layer;

an outer layer combinable with said inner layer to define a compartment;

said compartment at least partially bounded by a permanent attachment between said outer layer and said inner layer;

said compartment defining a volume substantially sufficient to hold a medical apparatus;

said compartment comprising a bracement for the medical apparatus;

said outer layer comprising a plurality of outer panels releasably attachable along a substantially vertical outer joint aligned approximately along a vertical centerline of a wearer of said garment;

said inner layer further comprising a releasably attachable substantially vertical inner joint for access to an anatomical region of a body of the wearer of said garment;

in a first operative mode, said inner joint releasably attached and said outer joint releasably attached, an opening to said compartment defining a first perimeter of a finite and non-zero length;

in a second operative mode, said inner joint releasably closed and said outer joint at least partially open, said opening to said compartment defining a second perimeter, a ratio of said second perimeter to said first perimeter between approximately 1.2 and approximately 10; and in said second operative mode, said substantially vertical outer joint intersecting a substantially non-vertical outer joint at an angle of from approximately 20 degrees to approximately 160 degrees.

3. The device according to claim 2, wherein a first lateral edge of said outer layer is located medial to a first lateral-most boundary of said garment, said first lateral-most boundary corresponding approximately to a first lateral-most portion of the body of the wearer of said garment.

4. The device according to claim 2, in said first operative mode, said substantially vertical inner joint substantially vertically aligned with a sternum of the wearer.

5. The device according to claim 2, in said first operative mode, said substantially vertical outer joint substantially vertically aligned with a sternum of the wearer.

6. The device according to claim 2, in said first operative mode, said substantially vertical inner joint substantially vertically aligned with said substantially vertical outer joint.

7. The device according to claim 2, said substantially vertical inner joint substantially extending from a neck opening of said garment to a lower portion of said garment.

8. The device according to claim 2, wherein at least one joint extending from a neck opening of said garment is releasably closable.

9. The device according to claim 2, said compartment comprising a means for substantially reducing visibility of the medical apparatus to an observer.

10. The device according to claim 2, said garment comprising a means for maintaining a body temperature of the wearer.

11. The device according to claim 2, said compartment comprising a means for substantially reducing discomfort to the wearer from the medical apparatus.

12. The device according to claim 2, said compartment comprising a means for substantially reducing operational interference with the medical apparatus.

13. The device according to claim 2, wherein said outer layer comprises at least one permanently attached joint on each outer panel.

14. The device according to claim 2, wherein, in said first operative mode, said compartment is openable via detachment of at least one of said plurality of outer panels.

15. The device according to claim 2, wherein, in said second operative mode, said compartment is closable via attachment of at least one of said plurality of outer panels.

16. The device according to claim 2, wherein said compartment is accessible through one or more sites along an edge of an outer panel from said plurality of outer panels.

17. The device according to claim 2, wherein in said first operative mode, said garment provides at least partial arm coverage.

18. The device according to claim 2, wherein in said first operative mode, said garment provides at least partial leg coverage.

19. The device according to claim 2, wherein in said first operative mode, said garment provides at least partial neck coverage.

20. The device according to claim 2, wherein in said first operative mode, said garment provides at least partial torso coverage.

21. The device according to claim 2, wherein in said first operative mode, said garment provides substantially no arm coverage.

22. The device according to claim 2, wherein in said first operative mode, said garment provides substantially no leg coverage.

23. The device according to claim 2, wherein in said first operative mode, said garment provides substantially no neck coverage.

24. The device according to claim 2, wherein said garment is releasably attachable about a crotch area of a wearer of said garment.

25. The device according to claim 2, wherein in said first operative mode, said compartment located substantially anteriorly with respect to the wearer.

26. The device according to claim 2, wherein in said first operative mode, said compartment located substantially laterally with respect to the wearer.

27. The device according to claim 2, wherein in said first operative mode, said compartment located substantially posteriorly with respect to the wearer.

28. The device according to claim 2, said compartment further comprising at least one internal pocket.

29. The device according to claim 2, said garment adapted to fit a mammal.

30. The device according to claim 2, said garment adapted to fit a non-human animal.

31. A device comprising:

a garment, comprising:

an inner layer;

an outer layer combinable with said inner layer to define a compartment;

a first lateral edge of said outer layer located medial to a first lateral-most boundary of said garment, said first lateral-most boundary corresponding approximately to a first lateral-most portion of a body of a wearer of said garment;

said compartment at least partially bounded by a permanent attachment between said outer layer and said inner layer;

said compartment defining a volume substantially sufficient to hold a medical apparatus;

said outer layer comprising a plurality of outer panels releasably attachable along a substantially vertical outer joint aligned approximately along a vertical centerline of the wearer of said garment;

said inner layer further comprising a releasably attachable substantially vertical inner joint for access to an anatomical region of the body of the wearer of said garment;

in a first operative mode, said inner joint releasably attached and said outer joint releasably attached, an opening to said compartment defining a first perimeter of a finite and non-zero length;

in a second operative mode, said inner joint releasably closed and said outer joint at least partially open, said opening to said compartment defining a second perimeter, a ratio of said second perimeter to said first perimeter between approximately 1.2 and approximately 10; and in said second operative mode, said substantially vertical outer joint intersecting a substantially non-vertical outer joint at an angle of from approximately 20 degrees to approximately 160 degrees.

* * * * *